US005156559A

United States Patent [19]

Sommer et al.

[11] Patent Number: 5,156,559

[45] Date of Patent: Oct. 20, 1992

[54] COUPLING DEVICE FOR A COAXIAL LINE SYSTEM

[75] Inventors: Ernst Sommer, Wolfratshausen; Helmut Wolf, Holzkirchen; Herbert Rosseg, Zorneding; Hans Mareis, Feldkirchen, all of Fed. Rep. of Germany

[73] Assignee: Messerschmitt-Bolkow-Blohm GmbH, Fed. Rep. of Germany

[21] Appl. No.: 801,468

[22] Filed: Dec. 2, 1991

[30] Foreign Application Priority Data

Dec. 5, 1990 [DE] Fed. Rep. of Germany ..... 4038817

[51] Int. Cl.[5] ..... H01R 4/02

[52] U.S. Cl. ..... 439/582

[58] Field of Search ..... 439/578-585

[56] References Cited

U.S. PATENT DOCUMENTS

| | | | |
|---|---|---|---|
| 4,049,902 | 9/1977 | de Ronde | 439/582 |
| 4,691,976 | 9/1987 | Cowen | 439/582 |
| 4,850,985 | 7/1989 | Arai et al. | 439/582 |
| 5,001,443 | 3/1991 | Martin, III | 439/582 |

FOREIGN PATENT DOCUMENTS 2701228 9/1978 Fed. Rep. of Germany .

*Primary Examiner*—Joseph H. McGlynn

*Attorney, Agent, or Firm*—Evenson, Wands, Edwards, Lenahan & McKeown

[57] ABSTRACT

A coupling device for two coaxial line systems which extend in planes disposed above one another. The coupling device comprises a pin, and a sleeve which is pushed over the pin in a no-contact manner, and between the interior conductors permits a high-frequency energy transmission.

20 Claims, 1 Drawing Sheet

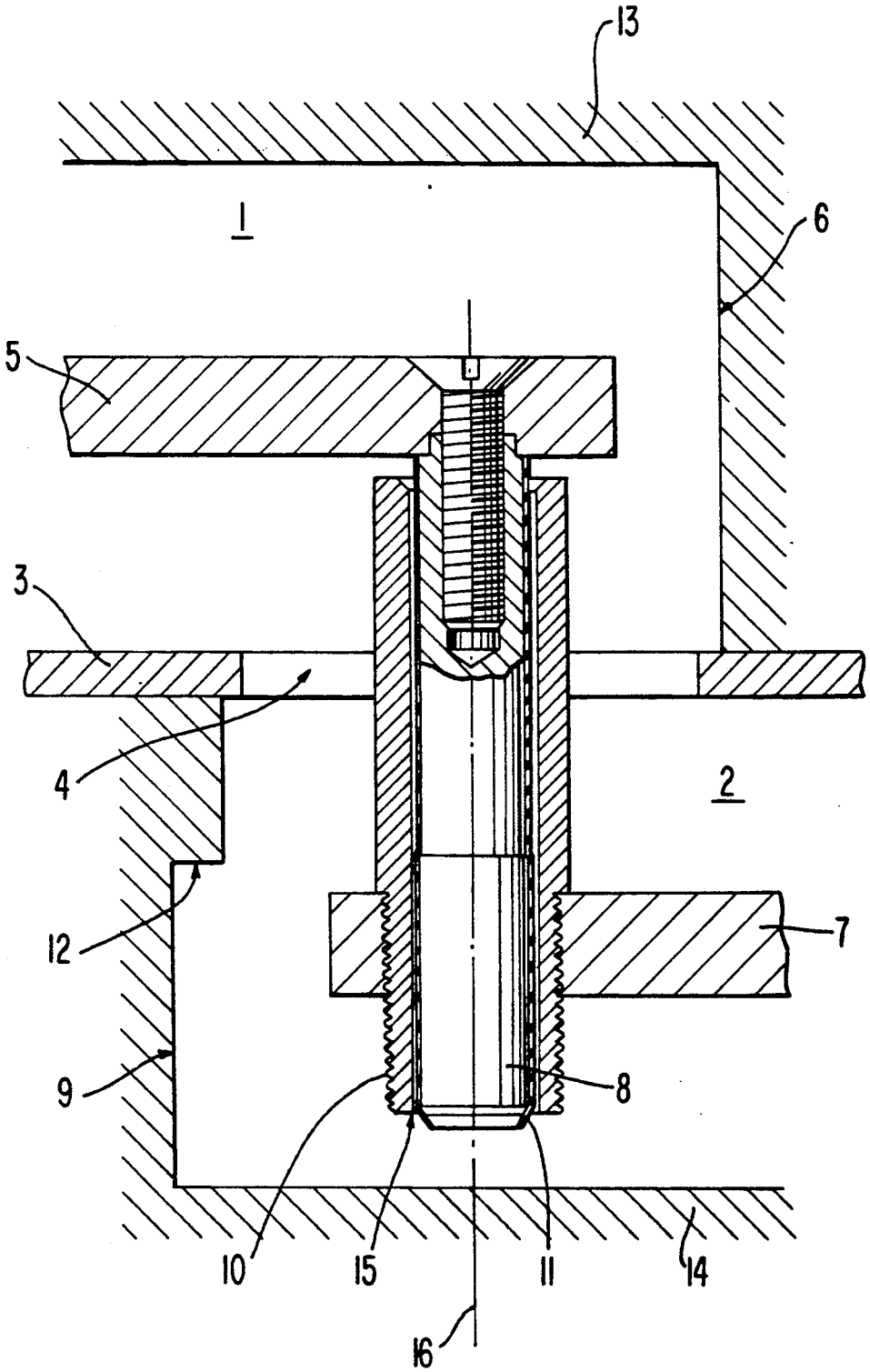
13
1
6
5
3
4
2
12
7
9
8
10
15
11
14
16

COUPLING DEVICE FOR A COAXIAL LINE SYSTEM

BACKGROUND AND SUMMARY OF THE INVENTION

The invention relates to a coupling device for a coaxial conductor system of the type in which conductor sections are formed in a planar member which defines external conductors with a rectilinear (generally, square or rectangular) cross-section in which, by means of dielectric supporting material, interior conductors are disposed which have a rectangular cross-section.

German Patent Document DE-PS 27 01 228, discloses a coaxial conductor system of the type referred to herein, which comprises exterior conductor sections of a square or rectangular cross-section embedded in a base plate in which a rectangular interior conductor is disposed by means of dielectric supporting material. The base plate is closed off by a planar covering plate. However, the subject patent reference fails to disclose any special embodiment of a coupling device suitable for use with such a coaxial conductor system.

Heretofore, it has been customary to construct coaxial coupling devices with parts which are rigidly screwed together. However, this system has the disadvantage that it is severely stressed mechanically by thermal expansion. Another embodiment with elastic plug contacts has the disadvantage of generating passive intermodulation products.

It is therefore an object of the present invention to provide a coupling device for coaxial conductor systems of this type (particularly for the coupling of two conductor sections arranged in planes disposed above one another) which is characterized by low losses and can also compensate for temperature-caused differences.

This object is achieved according to the invention, by means of a coupling comprising a pin mounted on the interior conductor of the first coaxial conductor which is inserted into a sleeve mounted on the interior conductor of the second coaxial conductor. The pin and sleeve extend through a coupling opening in a common wall shared by the exterior conductors of the respective coaxial conductors.

A particular advantage of the coupling device according to the invention is that the above-mentioned disadvantages of the prior art coupling devices are eliminated and that the compensation of different linear expansions because of a temperature gradient between interior and exterior conductors or due to different coefficients of expansion of the materials is possible.

Other objects, advantages and novel features of the present invention will become apparent from the following detailed description of the invention when considered in conjunction with the accompanying drawings.

BRIEF DESCRIPTION OF THE DRAWING

The single FIGURE of the drawing illustrates a representative embodiment of a coupling device according to the invention.

DETAILED DESCRIPTION OF THE DRAWINGS

The coupling device is used to transmit high frequency electromagnetic energy from a first coaxial conductor 1 of the type referred to above, into a second coaxial conductor 2 arranged below it. The exterior wall of the first coaxial conductor 1 is formed by a recess in a housing 13 which is covered by a plate 3. In the same manner, the second coaxial conductor 2 is embedded in the housing 14. In the common wall formed by the plate 3, a coupling opening 4 is provided. The vertical distance between the central axis 16 of the coupling opening 4 and the short circuits 6, 9 of the respective coaxial conductors 1, 2 is approximately half the transverse dimension of the respective coaxial conductors 1, 2. The interior conductors 5, 7 of the coaxial conductors 1, 2 extend slightly beyond the center of the coupling opening 4 in the direction of the respective short circuits 6, 9 terminating the respective coaxial conductors. In this case, the short circuits may be constructed as a plane or as a curved wall.

At the point where the central axis 16 of the coupling opening 4 passes through interior conductor 5 of the first coaxial conductor 1, a pin 8 is mechanically fastened to the interior conductor 5, which pin extends through the coupling opening 4 and into an opening in the interior conductor 7 of the second coaxial conductor 2. In a no-contact manner, a sleeve 10 surrounds pin 8 and is fastened to the interior conductor 7 of the second coaxial conductor 2. As can be seen from the FIGURE, pin 8 is slidably inserted into sleeve 10, and provides the coupling between the respective coaxial conductors 1 and 2; it can be withdrawn (upwardly in the FIGURE) to break the coupling and separate the coaxial conductors.

Between the pin 8 and the sleeve 10, a narrow air gap 15 is provided which is used to compensate for different temperature-caused linear expansions. Advantageously, the pin 8 is covered with a thin insulator made of, for example, the synthetic material known under the trademark name Teflon. The sleeve 10 extends from the interior conductor 7 of the second coaxial conductor 2 to close to the interior conductor 5 of the first coaxial conductor 1 without, however, coming in contact with it.

The design of the coupling device according to the invention may be optimized in a number of ways in order to adapt it to a particular environment. For example, the diameter of the coupling opening 4 can be varied relative to the outside diameter of the sleeve 10. Also, the pin 8 and the sleeve 10 may be guided through the interior conductor 7 of the second coaxial conductor 2 and may extend a distance beyond it as shown in the FIGURE. In the area of the short circuit 9, steps 12 may be provided in the exterior wall; and finally, the width of the rectangular interior conductor 5 and/or 7 may be decreased or increased in the area of the coupling device 8, 10.

Although the invention has been described and illustrated in detail, it is to be clearly understood that the same is by way of illustration and example, and is not to be taken by way of limitation. The spirit and scope of the present invention are to be limited only by the terms of the appended claims.

We claim:

1. A coupling arrangement for a coaxial conductor system of the type in which coaxial conductor sections are formed in a planar member which defines external conductors having a rectilinear cross-section in which interior conductors having a rectilinear cross-section are supported in a dielectric material, said coupling arrangement comprising:

first and second coaxial conductors which are disposed in parallel adjacency relative to each other with a common wall therebetween, said common wall forming a portion of the external conductor of each of said coaxial conductors and having a coupling opening between said first and second coaxial conductors;

an elongated pin mounted on an interior conductor of said first coaxial conductor and extending through said coupling opening to an interior conductor of the second coaxial conductor, said pin being separated from a short circuit terminating said first coaxial conductor, by a distance approximately equal to half of a transverse dimension of an exterior conductor of said first coaxial conductor;

a sleeve mounted on said interior conductor of said second coaxial conductor; said sleeve being slidably engaged with and surrounding said elongated pin without contact therewith, and extending through said coupling opening to a point in proximity with said interior conductor of said first coaxial conductor, and said sleeve being separated from a short circuit terminating said second coaxial conductor, by a distance approximately equal to half of a transverse dimension of an external conductor of said second coaxial conductor.

2. Coupling arrangement according to claim 1, wherein said rectilinear cross sections are square.

3. Coupling arrangement according to claim 1, wherein said rectilinear cross sections are rectangular.

4. Coupling arrangement according to claim 1, wherein said pin and said sleeve are mounted in an orientation substantially normal to said first and second coaxial conductors.

5. A coupling arrangement according to claim 4, wherein the pin and the sleeve on the interior conductor of the second coaxial conductor extend through and beyond said interior conductor of said coaxial conductor.

6. A coupling arrangement according to one of claim 4, wherein the cross-section of one or both interior conductors, can be changed in accordance with the requirements of the adaptation in the area of the coupling device.

7. A coupling arrangement according to claim 4, wherein in the area of the short circuits of the first or the second coaxial conductors, a device for an adaptation is provided.

8. A coupling arrangement according to one of claim 7, wherein the cross-section of one or both interior conductors, can be changed in accordance with the requirements of the adaptation in the area of the coupling device.

9. A coupling arrangement according to claim 1, wherein an insulator is interposed between the pin and the sleeve.

10. A coupling arrangement according to claim 9, wherein the pin and the sleeve on the interior conductor of the second coaxial conductor extend through and beyond the interior conductor of said second coaxial conductor.

11. A coupling arrangement according to claim 9, wherein in the area of the short circuits of the first or the second coaxial conductors, a device for an adaptation is provided.

12. A coupling arrangement according to claim 9, wherein the cross-section of one or both interior conductors, can be changed in accordance with the requirements of the adaptation in the area of the coupling device.

13. A coupling arrangement according to claim 1, wherein the pin and the sleeve on the interior conductor of the second coaxial conductor extend through and beyond the interior conductor.

14. A coupling arrangement according to claim 13, wherein the pin and the sleeve on the interior conductor of the second coaxial conductor extend through and beyond the interior conductor of said second coaxial conductor.

15. A coupling arrangement according to claim 13, wherein in the area of the short circuits of the first or the second coaxial conductors, a device for an adaptation is provided.

16. A coupling arrangement according to one of claim 13, wherein the cross-section of one or both interior conductors, can be changed in accordance with the requirements of the adaptation in the area of the coupling device.

17. A coupling arrangement according to claim 1, wherein in the area of the short circuits of the first or the second coaxial conductors, a device for an adaptation is provided.

18. A coupling arrangement according to one of claim 17, wherein the cross-section of one or both interior conductors, can be changed in accordance with the requirements of the adaptation in the area of the coupling device.

19. A coupling arrangement according to one of claim 1, wherein the cross-section of one or both interior conductors, can be changed in accordance with the requirements of the adaptation in the area of the coupling device.

20. A coupling arrangement according to one of claim 19, wherein the cross-section of one or both interior conductors, can be changed in accordance with the requirements of the adaptation in the area of the coupling device.

* * * * *